US005912634A

United States Patent [19]

Bunnen et al.

[11] Patent Number: 5,912,634

[45] Date of Patent: Jun. 15, 1999

[54] TRAFFIC MONITORING DEVICE AND METHOD

[75] Inventors: Bernard Van Bunnen; Marc Bogaert, both of Brussels; Jo Versaver, Kortrijk, all of Belgium

[73] Assignee: Traficon N.V., Kortrijk, Belgium

[21] Appl. No.: 08/714,173

[22] PCT Filed: Apr. 7, 1995

[86] PCT No.: PCT/BE95/00032

§ 371 Date: Dec. 9, 1996

§ 102(e) Date: Dec. 9, 1996

[87] PCT Pub. No.: WO95/27962

PCT Pub. Date: Oct. 19, 1995

[30] Foreign Application Priority Data

Apr. 8, 1994 [BE] Belgium ..... 9400369

[51] Int. Cl.[6] ..... G08G 1/017

[52] U.S. Cl. ..... 340/937; 340/933; 340/934; 348/149; 701/117

[58] Field of Search ..... 340/937, 933, 340/934, 935, 936, 903, 905, 917; 364/436, 437, 438; 348/116, 118, 148, 149; 701/117, 118, 119

[56] References Cited

U.S. PATENT DOCUMENTS

| | | | |
|---|---|---|---|
| 4,847,772 | 7/1989 | Michalopoulos et al. | 340/937 |
| 5,161,107 | 11/1992 | Mayeaux et al. | 340/937 |
| 5,296,852 | 3/1994 | Rathi | 340/937 |
| 5,396,429 | 3/1995 | Hanchett | 340/937 |
| 5,402,118 | 3/1995 | Aoki | 340/937 |
| 5,444,442 | 8/1995 | Sadakata et al. | 340/937 |
| 5,509,082 | 4/1996 | Toyama et al. | 340/937 |
| 5,535,144 | 7/1996 | Kise | 364/424.02 |

OTHER PUBLICATIONS

Morita, T. et al. "Image Processing Vehicle Detector for Urban Traffic Control Systems",VNIS '92 Vehicle Navigation & Information Systems, Oslo, N o pp.98–103.

Kelly, David "Results of a Field Trial of the Impacts Image Processing System for Traffic Monitoring", VNIS '91 Vehicle Navigation & Information Systems Conference Proceedings, SAE Warrendale US, pp.151–167.

*Primary Examiner*—Brent A. Swarthout
*Assistant Examiner*—Van T. Trieu
*Attorney, Agent, or Firm*—Dorsey & Whitney LLP

[57] ABSTRACT

A traffic monitoring device comprising a picture recording unit, a traffic dectection zone determination unit and a picture analysis unit, the traffic detection zone determination unit of which being provided to determine as traffic detection zone a follower axis extending substantially in parallel with a traffic axis in said traffic road and situated thereon, and in that said picture analysis unit is further provided to realize said verification pointwise on predetermined points situated on said follower axis and upon detection of such an object to assign thereon an identification pattern and to check within subsequent pictures within said sequence if patterns corresponding with said identification pattern occur.

15 Claims, 5 Drawing Sheets

TRAFFIC MONITORING DEVICE AND METHOD

RELATED APPLICATIONS

This application claims the priority of Belgium Patent Application No. BE09400369, filed Apr. 8,1994; and International Patent Application No. PTC/BE95/00032, filed Apr. 7, 1995, which are incorporated herein by reference.

BACKGROUND OF THE INVENTION

The invention relates to a traffic monitoring device comprising:

a picture recording unit provided for recording a sequence of successive traffic pictures of a same traffic road;

a detection zone determination unit connected with the picture recording unit and provided for determining a traffic detection zone within the traffic pictures of said sequence;

a picture analysis unit provided for cooperating with the picture recording unit and the detection zone determination unit and for verifying from each time a supplied traffic picture if an object to be identified as a vehicle is present within said traffic detection zone.

The invention also relates to a method for monitoring the traffic present on a traffic road.

Such a traffic monitoring device is known and brought on the market by Wootton Jeffreys Consultants under the name Impacts. A picture recording unit, formed by a TV camera, records successive pictures of a traffic. Within each picture a detection zone is determined within which the traffic will be analyzed. The picture analysis unit checks the picture content of the detection zone in order to verify if, within the detection zone, an object to be identified as a vehicle is present. This enables monitoring the traffic in an electronic manner and verification for example, if a traffic jam occurs. The latter is realized by verifying how many objects identified as vehicle are present in the recorded picture.

With the known traffic monitoring device a rectangle is used as detection zone, which rectangle is superposed on the picture of the road to be monitored. In such a manner the traffic road is divided into multiple rectangles. The dimension of each rectangle is chosen in such a manner that a vehicle can easily fit therein. If the picture analysis unit now establishes that more than one vehicle is present within such a rectangle, the latter is indicated in the recorded picture by way of a change in the color of the rectangle contours, for example from blue to red. This indicates where a problem is present within the traffic.

A drawback of the known traffic monitoring device is that by using rectangles the picture analysis unit has to take into account a large number of pixels, for each picture more than 2,000 pixels are taken into account which requires a considerable calculation capacity. Besides and in order to obtain a reliable system, it is necessary, as traffic situation can rapidly change, to have the pictures from the sequence succeeding rapidly one to another. This again imposes a high demand on the calculation capacity of the device.

A further drawback of the know traffic monitoring device is that upon analyzing the subsequent pictures no correlation is established between those pictures.

It is an object of the invention to realize a traffic monitoring device wherein, without reducing the reliability of the device, a relatively reduced calculation capacity is enough for what concerns the picture analysis, and wherein also a correlation between successive pictures can be determined.

SUMMARY OF THE INVENTION

A traffic monitoring device according to the invention is characterized in that said detection zone determination unit is provided to determine as a traffic detection zone, a follower axis which is situated within and extends substantially parallel with a traffic axis within said traffic road, and in that said picture analysis unit is further provided to execute said verification pointwise on a predetermined point situated on said follower axis and, upon detection of such an object, to assign thereon an identification pattern and for taking from subsequent traffic pictures within said sequence if patterns corresponding with said identification pattern arise. By selecting a follower axis as a traffic detection zone, the number of considered pixels is substantially reduced. Because the follower axis is situated on the traffic axis, a reduced calculation capacity is enough, without reducing the reliability of the device. Because the traffic will mainly move along said follower axis, the reliability of the detection is enhanced. By further assigning an identification pattern to an object identified as a vehicle and verifying if that identification pattern is repeated over successive pictures, the displacement of the vehicle can be observed because in such a manner a correlation between successive pictures is established.

A first preferred embodiment of a device according to the invention is characterized in that said traffic detection zone determination unit is provided to superpose for said follower axis a predetermined line stroke on said traffic picture. This determination of the follower axis is herewith realized in a simple and reliable manner.

A second preferred embodiment of a traffic monitoring device according to the invention is characterized in that said picture analysis unit is provided to determine a grey value for said pixel upon said verification, and for verifying if said grey value exceeds a predetermined threshold, and for determining said identification pattern with said grey value upon said exceeding. In particular when use is made of video pictures, the grey value of a pixel can be determined in a simple manner and digitally converted. The calculation with digitized grey values is moreover rapidly executed, which enables to realize the comparison with the threshold value in a quick and easy manner. Besides the latter offers a reliable manner to determine the identification pattern.

It is favorable that said picture analysis unit is provided to determine said grey value from an average value of n (n>1) neighboring pixels. This enables to realize a noise filtering operation on the picture data.

A third preferred embodiment of a traffic monitoring device according to the invention is characterized in that said picture analysis unit is provided to apply a Laplacian operation on said grey value and for determining therefrom a Laplacian operator and for checking the value of the latter to said threshold. The determination of a Laplacian operator can be realized in an electronic manner with simple means.

A fourth preferred embodiment of a traffic monitoring device according to the invention is characterized in that said picture analysis unit is provided for delimiting a first picture window for each grey value which exceeds said threshold, which first picture window is situated around the pixel to which that grey value belongs, and for determining said identification pattern within said first picture window. Limiting the first picture window offers the possibility to determine the identification pattern within the first picture window. The identification pattern extends in such a manner over a plurality of pixels which enables to search with a higher reliability corresponding patterns.

A fifth preferred embodiment of a traffic monitoring device according to the invention is characterized in that said picture analysis unit is provided for determining a second picture window starting from said first picture window and for stepwise shifting, with a predetermined increment, said second picture window each time along said follower axis, and for executing with each step that said second picture window has been shifted said verification if corresponding patterns appear. In such a manner the identification pattern is shifted together with the second picture window and the search for corresponding patterns is limited to a search within that second picture window.

A favorable way to determine the correlation between the first and the second picture window is characterized in that said picture analysis unit is provided for determining a further identification pattern upon said step within said second picture window and for determining correlation value from said further identification pattern and said identification pattern, and for verifying if said correlation value exceeds a further threshold value.

The invention will now be described in more detail by means of the drawing wherein:

Figure 1:
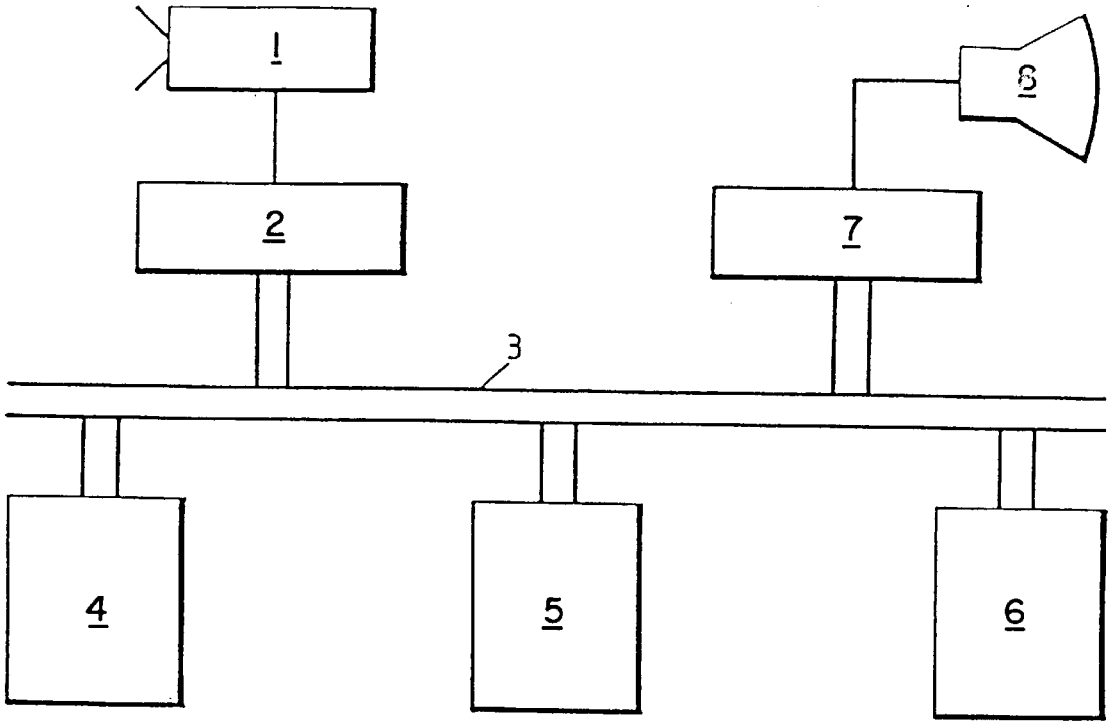
FIG. 1 shows schematically an embodiment of a traffic monitoring device according to the invention.

In the drawings a same reference has been assigned to same or analogous elements.

DETAILED DESCRIPTION OF THE PREFERRED EMBODIMENTS

A traffic monitoring device according to the invention and of which an embodiment is shown in FIG. 1 comprises a picture recording unit 1, for example formed by a CCD-camera. The picture recording unit is provided to be installed along a road in order to record the traffic present on the road. The recorded pictures are supplied to an analog to digital converter 2 where they are digitized. The converter 2 is connected with a bus 3 provided i.e., for the transport of data and instructions. A data processing unit 4, for example formed by a microprocessor, is further connected to the bus 3 as well as a read memory 5 (ROM) and a read-write memory 6 (RAM). A picture generator 7 is further connected to the bus 3, an output of said picture generator being connected with a monitor 8.

The picture recording unit and the remaining components are not necessarily installed on the same place. Preferably said remaining components will be installed a traffic monitoring centrum of the competent authority.

In the data processing unit 4 and/or in the memories 5, 6 data and instructions are stored which enables performing an analysis of the recorded traffic picture. The data processing unit 4 and the memories 5, 6, as well as the bus 3 form in such a manner a picture analysis unit. Before entering into more detail in the operation of the picture analysis unit, the concept of a "follower axis" will first be explained.

Figure 2:
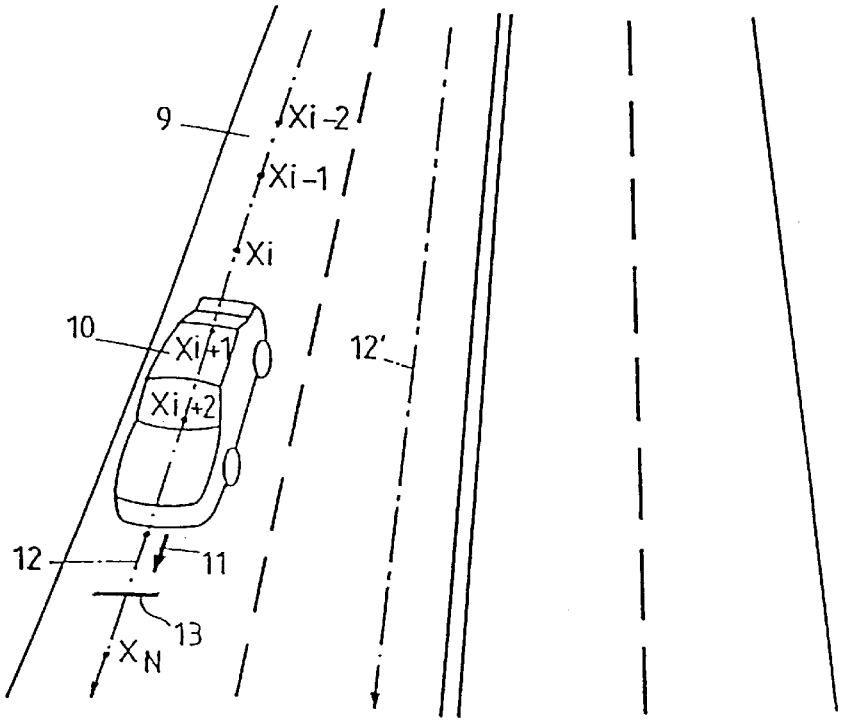
FIG. 2 illustrates the concept "follower axis"

FIG. 2 shows a traffic picture wherein a part of a traffic road 9 is represented, on which traffic road there is a vehicle 10 moving in the direction of the arrow 11. That direction is the one of the traffic axis along which the traffic normally moves. The follower axis 12 is now defined according to a direction which extends substantially parallel with the traffic axis, in the example shown in FIG. 2, thus in parallel with arrow 11. The follower axis is localized in such a manner in the picture so as to be present in the part of the road where the probability of the presence of a vehicle is the largest. So for example, when the follower axis is placed in a stroke of a two-way road, the follower axis will be put in the middle or somewhat shifted to the right side of the road with respect to the middle (for rightside moving traffic). On a road with two or more strokes such as shown in FIG. 2, the follower axis 12 respectively 12' is for example positioned in the stroke situated at the utmost right respectively utmost left part in such a manner that with respect to the middle of the stroke the follower axis is somewhat shifted (for example 15%) towards right respectively towards left.

The follower axis 12 (or 12') is determined on beforehand upon installation of the picture recording unit, although when the latter has a fixed position. Once the picture recording unit is installed, a follower axis is superposed on the recording picture, which follower axis is determined on beforehand and thus remains unchanged. It is however also possible to have the picture recording unit change its position, for example a first position during the morning peak and a second position during the evening peak. With the latter consideration, use is made of two predetermined follower axes, and there is switched between a first and a second follower axis depending on the position taken by the picture recording unit.

Instead of operating with a predetermined follower axis, it is also possible to build up the follower axis strokewise as a function of the local traffic density. This is for example advantageously on a crossroad where every traffic participant does not necessarily follow a same route when he turns to one or another direction. By strokewise building up the follower axis as a function of the local traffic density on different points of the road or the crossroad, it is possible to regularly "actualize" the follower axis. Besides this avoids, when a vehicle would leave the predetermined follower axis, that the monitoring of the progression of the vehicle would be disturbed. The strokewise building up of the follower axis is realized by starting with an initial stroke and thereafter by varying each further stroke with respect to the previous one over an angle and by verifying at which angle a vehicle is detected with the largest probability or the highest clearness. The angle variation $\alpha$ compromise for example $-15° < \alpha < 15°$. The angle at which the highest probability is established is then also the selected one.

Figure 6:
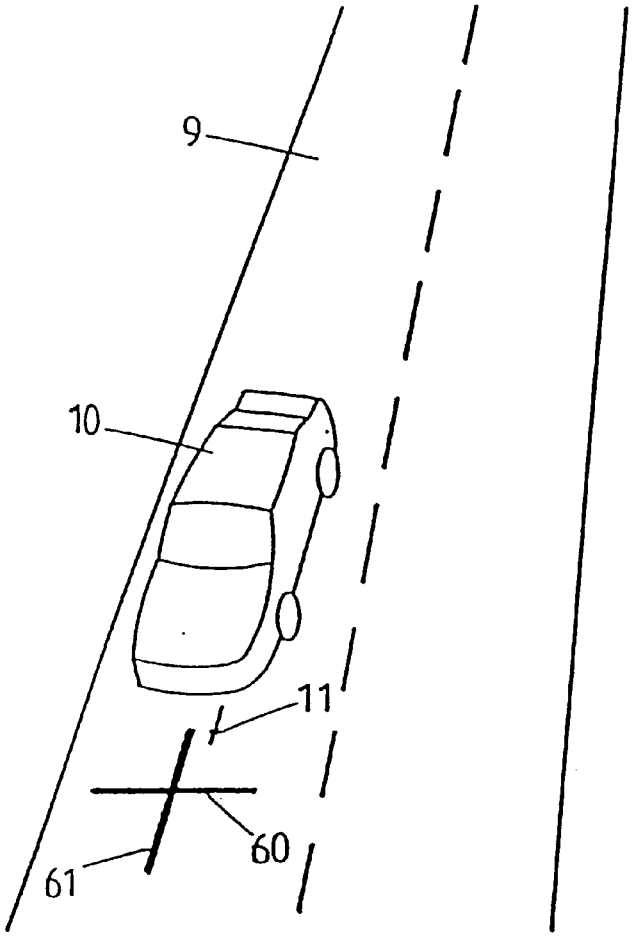
FIG. 6 shows an alternative way for determining the follower axis.

An alternative embodiment for determining the follower axis is shown in FIG. 6. In this embodiment the follower axis forms a start line 61 which crosses a gate line 60. The gate line is located perpendicular to the traffic stroke, preferably at the underside of the picture. The gate line offers the possibility to divide the flux of vehicles in successive vehicles. Crossing the gate line by a vehicle is detected for example by means of a determination of the grey value as will be described hereunder. Not only the passage of the front side of the vehicle but also the backside of the vehicle is detected in such a manner that a pattern as shown in FIG.

7 is created. A block VA indicates the presence of a vehicle. A block of the size as shown by block VA-3 indicates that the vehicle needed a long time to cross the gate line, in such a manner that this indicates a possible traffic jam.

The start line 61 is disposed in a direction which extends substantially parallel with the traffic axis (parallel to arrow 11). The start line crosses the gate line in the middle as soon as the presence of a vehicle is recognized. Because the vehicle has crossed the gate line, the device will follow the characteristics appearing on the start line, for example the grey value, which corresponds with the vehicle to be followed. The thus determined grey value profile corresponding with the vehicle will then be followed.

The zone within which the presence of traffic will be checked is thus defined by means of the follower axis. In order to realize the latter detection, a number (N) of points (Xi) ($1 \leqq i \leqq N$) is fixed on the follower axis. The grey value of those points will now each time be determined, thus giving an indication for the presence thereon of a vehicle. The grey value is preferably represented by means of an 8 bits word thus providing 256 values.

This detection is however not limited to only the points or pixels Xi. In order to limit the noise in reality a stroke 13 with a width of n (for example $1 \leqq n \leqq 10$) pixels is fetched from the recorded picture. Preferably those n pixels are selected in a direction substantially perpendicular on the follower axis. A vehicle has indeed always a certain width. When the vehicle moves along the follower axis, then a same grey value level will be present in the picture on an n pixels line stroke substantially perpendicular on the follower axis. The width n of the selected stroke can vary as a function of the position in the picture. Preferably, by linewise picture build up, the n pixels will be selected within the same pixel line, which simplifies the calculation. The n pixels can however also be selected along the follower axis itself or form with respect to a follower axis an angle β, $0 \leqq \beta \leqq 135°$, depending on the bending of the follower axis within the recorded picture.

When use is made of a gate line 60 and a start line 61, the pixels are of course selected on the start line itself. The start line itself is one or more, for example 3, pixels large.

The pictures recorded by the picture recording unit are digitalized and only those pixels situated in a stroke of n pixels around the follower axis, as described herebefore, will be taken into account. To this purpose for example and the digitized pixels are stored in a memory 6 and only those pixels which belong to said stroke will afterwards be read and processed by the data processing unit 4. This selected reading is for example realized by selectively addressing the memory 6 by means of an address generator programmed in function of the position of the follower axis in the picture. This address generator operates then as a detection zone determination unit in order to determine the correct traffic detection zone in the picture. Other embodiments as selective writing in the memory are of course also possible.

Figure 3A:
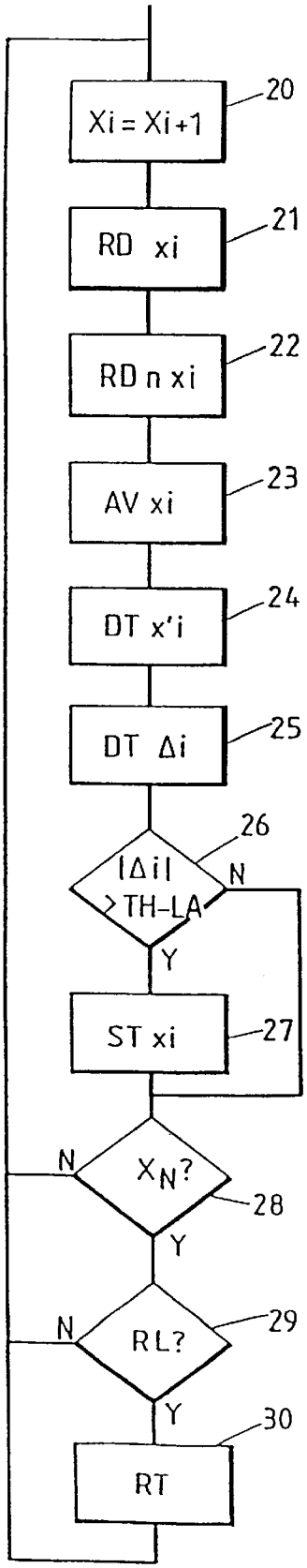
FIGS. 3*a+b* shows by means of a flow-chart the operation of a traffic monitoring device according to the invention.

The flow-chart represented in FIG. 3*a* illustrates the selection of the relevant pixels with a traffic monitoring device according to the invention. The different steps of the flow-chart will now be described.

20. $X_i = X_i + 1$: The pixel $X_i$ to be processed and belonging to the follower axis of a same picture is selected. To this purpose a modulo N counter is for example used which operates as an address generator. The counter sequentially counts each time with a single increment to address in such a manner the different pixels.

21. $RDx_i$: The grey value $x_i$ of the selected pixel $X_i$ is fetched.

22. $RDnx_i$: The grey value $x_{ij}$ of each of the n pixels, direct neighbours of $X_j$, as described herebefore are also fetched ($1 \leqq j \leqq n$). The value of n can here vary in function of the camera angle and the position of $X_i$ in the picture.

23. AV $x_i$; The mathematical operation $$\bar{x}_i = (n+1)^{-1} \sum_{j=1}^{n} x_i + x_{ij}$$

is now realized in order to determine for the grey value of the pixel $X_i$ an average value $\bar{x}x_i$; considered over its direct neighbours and in such a manner to limit the picture noise. Division by (n+1) may however not be performed because relative and not absolute values are considered.

24. DT $x_i'$: In order to further limit the picture noise a low pass filtering is applied on the picture signal. Mathematically the following operation is therefore applied:

$$x_i' = \bar{x}_{i-1} + \bar{x}_i + \bar{x}_{i+1}$$

wherein there is started from the average grey value $\bar{x}_i$ pertaining to the pixel $X_i$ a substitution value $x_i'$ being determined by adding to $\bar{x}_i$ the values $\bar{x}_{i-1}$ and $x\bar{x}_{i+}$ of its closest neighbours.

25. DT Δi: In order to verify if the value $x'_i$ is relevant, i.e., represent the presence of a vehicle, an identification operation is applied thereon. This identification operation can take different aspects. So, for example it can be simply checked whether the grey value xi'exceeds a predetermined threshold value. In order however to take into account different factors, such as light intensity, camera sensitivity, wet road, etc., which strongly influence the absolute grey value of the pixel, the relative rather than the absolute grey value is taken into account. In the present embodiment a Laplacian operator is calculated on the basis of the grey value $x'_i$;

$$\Delta i = x'_{i-2} - 2x'_i + x'_{i+2}.$$

This enables verifying whether the point $X_i$ has clearly different grey value with respect to point $X_{i-2}$, $X_{i+2}$. Instead of determining a Laplacian operator, it is also possible to determine the evolution of $X'_i$, with respect to the average values of its closest neighbours $x_{i\pm p}'$ ($1 \leqq p \leqq 3$).

26. $|\Delta| > TH\ LA$?: Here is verified if the absolute value of the Laplacian Δi exceeds a predetermined threshold value $TH_{13}$ LA. If this is not the case, then a jump to step 28 is performed.

27. ST xi: When the Laplacian operator $|\Delta i|$ exceeds the value TH_LA, then the point $X_i$ is considered as relevant. Indeed passing the value $TH_{13}$ LA indicates the possible presence of a vehicle. The point $X_i$ and the pertaining value $x'_i$ are temporarily stored in the memory.

28. $X_{n?}$: There is verified if the considered point $X_i$ is the last one of a series of N points. If not, a subsequent point $X_i$ is taken account and the steps 20 to 28 are repeated.

29. RL ?: There is verified if relevant points $X_i$ are stored in the memory. If not, a subsequent picture from the picture sequence recorded by the picture recording unit is taken into account.

Figure 3B:
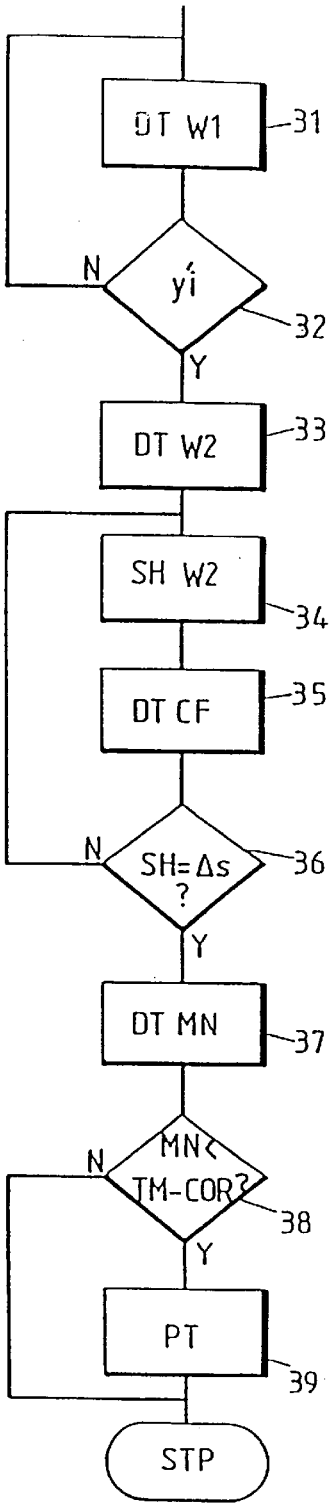

30. RT: In the presence of relevant points another routine (represented in FIG. 3*b*) is activated. This other routine is preferably executed simultaneously with the routine as shown in FIG. 3*a*.

Figure 7:
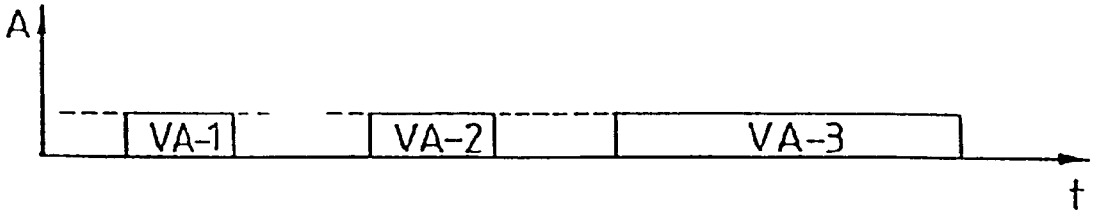
FIG. 7 shows a vehicle presence pattern where use is made of the follower axis together with a gate and start line.

When use is made of a gate line and a start line, transgressing the threshold value on pixels belonging to the start line is monitored. Once a first transgression of the threshold value is determined on the gate and start line, there is verified also in subsequent traffic pictures if on the start and gate line the transgression does not stop. Indeed, stopping of the transgression of the threshold value signifies that the extremity of the vehicle has crossed the gate line and that the vehicle has been detected as a whole. The occurrence respectively the stopping of the transgression of the threshold value on the start line generates a start respectively an end pulse in order to obtain a presence pattern as shown in FIG. 7.

Figure 4A:
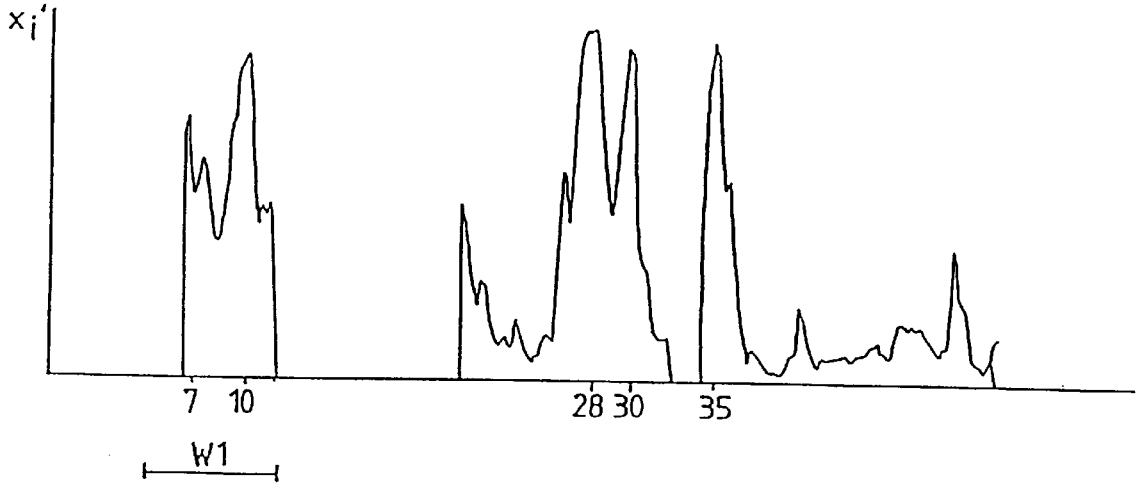
FIGS. 4*a+b* illustrates the concept "first and second picture window"

A graphic illustration of the grey value $x_i$ as function of the position $X_i$ on the follower axis is represented in FIG. 4*a*. From this example it appears that when, for example $TA_{13}$ LA=150, that at the pixels 7, 10,28,30 and 3~5 a vehicle is probably present, because at that location relevant information is present of which the Laplacian operator $|\Delta i|>TA_{13}$ LA. Those points have been detected in order now to verify if that identification pattern repeats itself in subsequent pictures, whether or not shifted in the direction of the follower axis. A shift along the follower axis indicates indeed that a movement is present in the traffic, while a standing still or slow shift indicates a traffic jam.

In order to now verify if in subsequent pictures corresponding patterns occur, a first picture window is delimited for each pixel $x_i$ of which $|\Delta i|>TA_{13}$ LA. This is realized in step 31 DTW.1 of the pixels, for example L=6 and is centralized along the pixel $X_i$. The grey value of the pixels within that first window W1 now forms an identification pattern of which there will be tried to find it back in subsequent pictures.

In the examples shown in FIG. 4*a* a first picture window WI is thus established around pixel 7. Pixels 4 to 10 belong now to that first window and the identification pattern comprises the points 7 and 10 which had a Laplacian larger that $TH_{13}$ LA. A further first picture window will be applied around pixels 28,30 and 35.

Figure 4B:
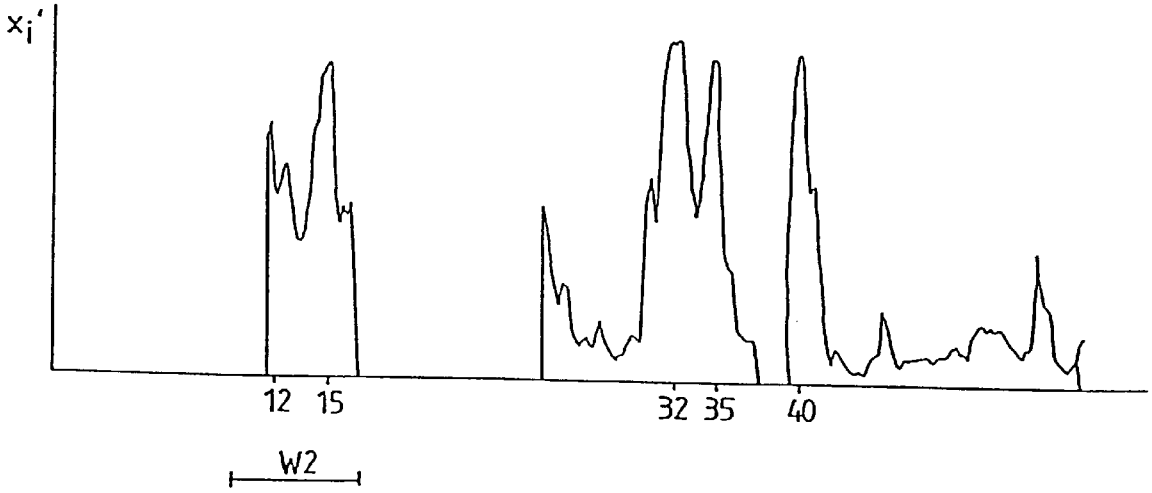

In order to verify now if corresponding patterns, as those present in the first picture windows, occur in the subsequent traffic pictures, the data from the first picture windows is temporarily stored until again the steps shown in FIG. 3*a* have been executed for a subsequent picture. In order to distinguish the grey value data of that subsequent picture from those ($X'_i$) of the preceding picture, the one belonging to that subsequent picture will be indicated as $y'_i$. The grey value $y'_i$ is determined in a analogous manner as $x'_i$. FIG. 4*b* shows an example of the grey value $y'_i$ . In such a manner with pixel 12 there belong a grey value $y'_i$ with a Laplacian $|\Delta i|>TA_{13}$ LA.

After the grey value $y'_i$ ($y'_i$?:32 FIG. 3*b*) has been determined, a second picture window W2 (DT W2; 33 FIG. 3*b*) is determined. This second picture window has the same dimension as the first W1, and is initially positioned on the same location as the first picture window. Thereafter, the second picture window is shifted in the direction of the follower axis (SH W2; 34), each time with a predetermined increment of for example one position on the follower axis. For each shifting of the second picture window a correlation factor (DT CF, 35) is determined. This correlation factor CF is for example determined by applying the subsequent mathematical operation:

$$CF = \sum_{m=1}^{L+1} |x_m - y_m|$$

(L+1 being the total number of points situated on the follower axis within the second picture window). The correlation factor is at a minimum value when the patterns substantially correspond and increases the more the difference arise between the patterns. For each shifting of the second picture window the correlation factor is temporarily stored, coupled with the pertaining position of the second picture window.

After having determined the correlation factor there is verified if the second window did already reach its maximum shaft Δs (SH=Δs ? 36). Indeed between two successive pictures, a vehicle in movement will have accomplished a certain distance. The shift of the second picture window may then be limited over a predetermined number for example Δs =6 pixels. If that maximum has not been reached, then the second window is shifted over one pixel and the steps 34 and 35 are repeated.

If the second picture window has reached its maximum shift with respect to the first one (35,Y), then (DT MN:37) that position of the second picture window is selected wherein CF had the lowest value. Indeed there one expects to obtain a pattern corresponding with the identification pattern. Subsequently there is verified if that lowest value is less than a threshold value $TH_{13}$ COR for the correlation value (MN<TH_COR?; 38). If so, (38:y) then a subsequent calculation (PT; 39) such as for example the displacement of the vehicle is determined. Thereafter that routine is finished and a new determination for a following picture can be started. The calculation of the displacement or the vehicle speed is realized by determining the difference in the position of the two picture windows. If MN>TH_COR this signifies that no corresponding patterns have been found.

In the example shown in FIG. 4, when the second picture window W2 is shifted over 5 position with respect to the first one, a correspondence is obtained between the first and the second picture window content. The identification pattern present in that first picture window is thus shifted in the subsequent picture over 5 positions, which indicates that the vehicle associated therewith did move in the mean time.

In the alternative solution where use is made of a gate line and a start line, each time after the displacement of the vehicle has been established (step 38) such as described, at least the start line but preferably also the gate line, is again determined for that vehicle in order to follow that vehicle over the road. For each vehicle there is thus started with a predetermined gate and start line which subsequently evolutes in function of the path accomplished by the vehicle. In function of the place where the vehicle has been detected in the picture and in function of the course of the road on which the vehicle moves, the gate line is again centralized with respect to the; middle of the vehicle or the middle of the road. The start line is then again localized in the middle of the thus determined gate line. By such a combination of start and gate line, the course of the vehicle moving along a roundabout is for example followed. Once a combination of gate and start line has been determined, it is also possible to have them shifted within the picture by means of a predetermined incrementation after the presence of the vehicle has been detected. The predetermined incrementation is then corrected when the grey value determination shows that the vehicle to be followed is no longer on the expected route, such as determined by the predetermined incrementation.

The traffic monitoring device according to the invention thus enable to monitor on a reliable and simple manner the traffic progression. When the traffic stand still the identification pattern in the picture will also stand still. Correspondence between the picture content of the first and second picture window will then be found a substantially identical positions within the picture. The detection of such a correspondence on identical picture positions, or establishing that the speed at which the vehicle moves is substantially equal to zero, leads to the generation of a traffic jam warning signal. That traffic jam warning signal is also generated when the observed speed has dropped below a predetermined under threshold. The latter situation indeed indicates a slowly moving traffic which is the characteristic of a traffic jam. The traffic jam warning signal is switched off when the speed of the traffic again exceeds the predetermined value.

The device according to the invention is preferably provide to measure the time duration of a traffic jam. To this purpose a counter is started upon generating the traffic jam warning signal which counter is then stopped by switching off that signal.

Upon traffic jam detection it is favorable to select the follower axis sufficiently long in such a manner that it is not sensitive to small movements within the traffic jam. In order not to generate unnecessarily for each short traffic jam a signal, it is favorable that the latter signal is only generated when the traffic jam remains during a predetermined time, for example of 3 minutes.

Figure 5:
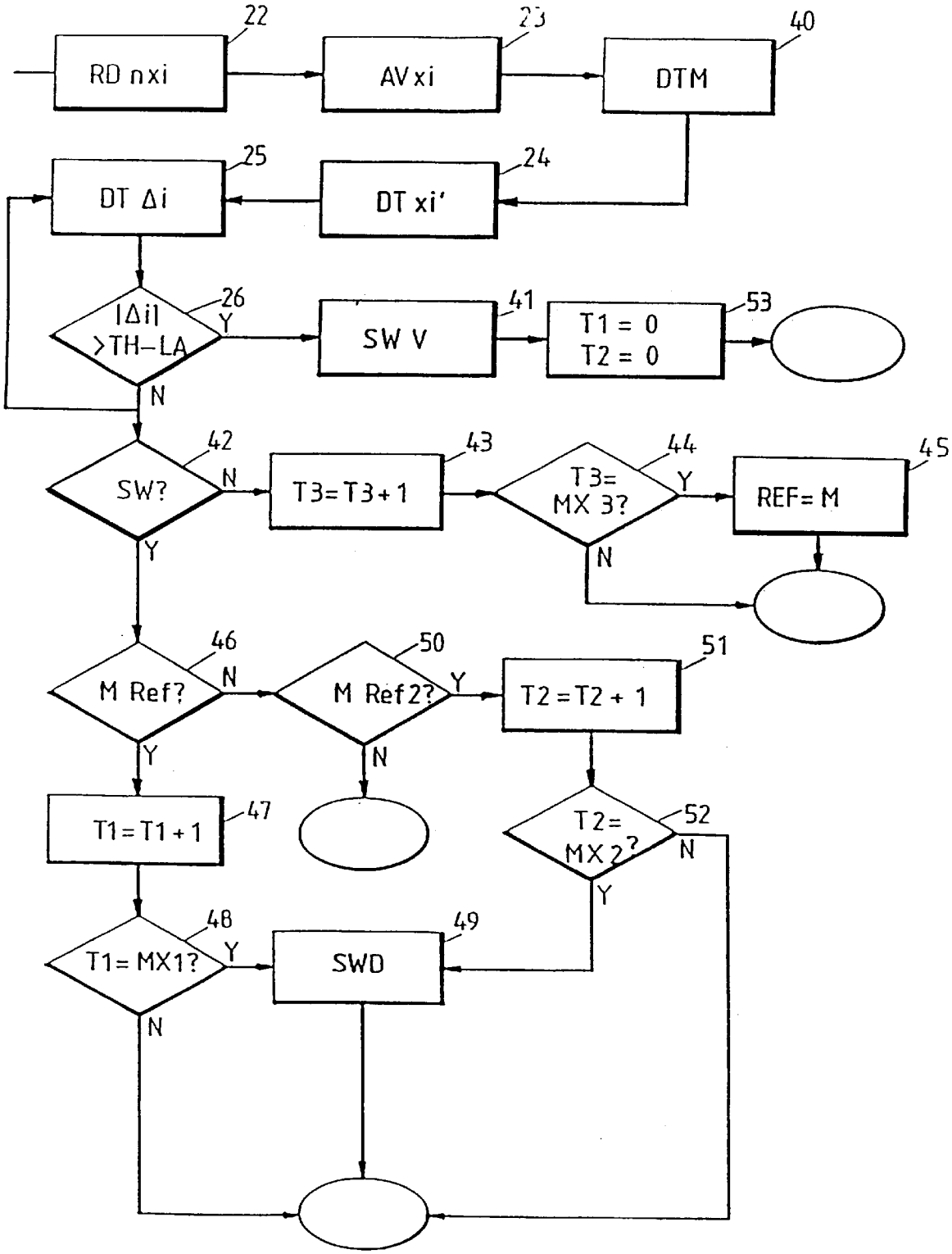
FIG. 5 illustrates by means of flow-chart an alternative embodiment for the operation of a traffic monitoring device according to the invention.

FIG. 5 shows a flow-chart wherein an alternative embodiment is represented. Some of the steps are analogous to the one in the routine shown in FIG. 3*a* and carry then also the same reference. The routine shown in FIG. 5 is provided to use the device according to the invention also as a traffic frequency/density counter. To that purpose, an improvement is applied to the routine wherein the determination of a Laplacian operator $\Delta x_i$ >TH_LA will lead to the acceptance that in the subsequent picture such a determination will most probably again take place. To this purpose the average grey value of the identification pattern is determined and compared with a reference value which is regularly adapted. When the average grey value is less than or equal to a first value P representing a background grey value and repeating itself over a number of pictures (for example 5) then there can be determined with certainty that no vehicle is present. That calculation serves in particular to take into account a modification in the light intensity.

The flow-chart represented in FIG. 5 now comprises the following steps:

40. DTM: An average value M is calculated from the values $\bar{x}_i$ $$M = \sum_{i=1}^{N} \bar{x}_i$$

This value is determined for all points N of the follower axis.

41. SW V: When |Δi|>TH_LA this indicates the presence of a vehicle and a vehicle presence signal V is generated and the frequency counters $T_1$ and $T_2$ (step 53; $T_1$=0, $T_2$=0) are reset. The function of those frequency counters $T_1$ . and $T_2$ will be described hereinafter.

42. SW?: There is checked if a vehicle presence signal V has already been generated.

43. $T_{3\ =T3\ +1}$ : If no signal V has been generated, then the counter $T_3$ is incremented. The counter $T_3$ serves to update regularly the reference value in order to take into account light intensity variation. The counter $T_3$ is only incremented when |Δ|<TH_LA and the signal V is not active. The counter $T_3$ counts the number of pictures.

44. $T_3$=MX 3?: There is checked if the counter $T_3$ indicates a maximum value. This maximum value is for example equal to 10 pictures.

45. REF=M: If the counter $T_3$ indicates a maximum value, then the first reference value P is substituted by a value M determined by step 40. This enables to set an actual background grey value and thereafter the counter $T_3$ is reset.

46. M Ref 1?: There is now check if the value L=M/P is situated within a first area Q which indicates for example 4% of the maximum intensity.

47. $T_1$=$T_1$+: When L∈Q the counter $T_1$ is incremented. The counter $T_1$, counts the number of subsequent pictures after that signal V has been generated, and for which |Δi |<TH_LA. Such a situation occurs for example when in one picture, due to a disturbance or a sudden intensity variation, an object has been identified as a vehicle (|Δi |>TH_LA) , and with subsequent pictures that same object is no longer to be identified.

48. $T_1$=MX 1?: There is checked if counter $T_1$ , indicates a maximum value. This maximum value comprises for example two pictures.

49. SWO: When $T_1$ indicates a maximum value, the vehicle presence signal V is switched off and the vehicle frequency counter is incremented by one unit. The signal V had indeed been generated. The value P is now set equal to M and the counters $T_1$, $T_2$ and $T_3$ are reset.

50. M Ref 2?: There is checked if the value L=M/P is situated within a second area Q', which indicates for example 30% of the maximum intensity.

51. $T_2$=$T_{2+1}$: When L∈Q'is the counter $T_2$ incremented. The counter $T_2$ has an analogous function as the counter $T_1$, but $T_2$ counts those pictures wherein a reasonable (larger than 30%) intensity is still present. Such a situation occurs for example when a long truck with a uniform insufficiently distinguishable color, such as white, crosses the picture. The intensity is not enough because absolute value |Δi |<TH_LA, but the vehicle is indeed present.

52. $T_2$=MX 2?: There is checked if the counter $T_2$ indicates a maximum value and if so there is switched to step 49. The maximum value comprises for example 5 pictures.

We claim:

1. A traffic monitoring device comprising:

a picture recording unit provided for recording a sequence of successive traffic pictures of a same traffic road;

a detection zone determination unit connected with the picture recording unit and provided for determining a traffic detection zone within the traffic pictures of said sequence by superposing on said traffic picture a follower axis, comprising a predetermined number of points ($X_i$) distributed thereover, said follower axis being situated within and extending substantially in parallel with a traffic axis within said traffic road; and a picture analysis unit provided for cooperating with the picture recording unit and the detection zone determination unit and for determining on a grey value of at least two of said successive points ($X_i$) within each supplied traffic picture and for verifying if said grey value exceeds a predetermined threshold on said at least two successive points of said follower axis and for assigning to said points for which said grey value exceeds said threshold an identification pattern, said picture analysis unit being also provided for checking within subsequent traffic pictures of said sequence if said identification pattern is again assigned to at least two points.

2. A traffic monitoring device as claimed in claim 1, characterized in that said detection zone determination unit is provided for strokewise dividing said follower axis, said detection zone determination unit being further provided for calculating a further follower axis by starting from an initial stroke of said follower axis and modifying the orientation of further strokes of said follower axis with respect to said initial stroke, said picture analysis unit being provided for applying said verification on said modified further strokes and said initial stroke and for selecting that further follower axis which has the highest probability that a vehicle is to be detected thereon.

3. A traffic monitoring device as claimed in claim 1, characterized in that said traffic detection zone determination unit is provided to superpose a gate line for said traffic detection zone on said traffic picture and for applying for said follower axis a start line crossing said gate line.

4. A traffic monitoring device as claimed in claim 3, characterized in that said picture analysis unit is provided to execute said verification on pixels belonging to said gate line, and for generating a start pulse when said grey value exceeds said threshold for pixels on said start line and said gate line and for verifying upon successive pictures when said exceeding of said grey value for pixels on said start and gate line stops, and for generating a final pulse upon said stopping.

5. A traffic monitoring device as claimed in claim 4, characterized in that said picture analysis unit is provided for determining after generating said start pulse said identification pattern on said start line.

6. A traffic monitoring device as claimed in claim 3, characterized in that said picture analysis unit is provided to determine said grey value from an average value of n (n>1) neighboring pixels of the considered point ($X_i$) of said follower axis.

7. A traffic monitoring device as claimed in claim 6, characterized in that said picture analysis unit is provided to determine said average value from neighboring pixels situated substantially perpendicular on said follower axis.

8. A traffic monitoring device as claimed in claim 6 or 7, characterized in that said picture analysis unit is further provided for determining said average value from neighbouring pixels situated on said follower axis.

9. A traffic monitoring device as claimed in claim 1, characterized in that said picture analysis unit is provided to apply a Laplacian operation on said grey value and for determining therefrom a Laplacian operator and for checking the value of the latter to said threshold.

10. A traffic monitoring device as claimed in claim 1, characterized in that said picture analysis unit is provided for each time assigning a first picture window to those successive points of said follower axis to which said identification pattern has been assigned.

11. A traffic monitoring device as claimed in claim 10, characterized in that said picture analysis unit is provided for determining a second picture window starting from said first picture window and for stepwise shifting with a predetermined increment said second picture window each time along said follower axis, and for executing with each step that said second picture window has been shifted said verification if corresponding patterns appear.

12. A traffic monitoring device as claimed in claim 11, characterized in that said picture analysis unit is provided for determining a further identification pattern within said second picture window and for determining a correlation value from said further identification pattern and said identification pattern, and for verifying if said correlation value exceeds a predetermined threshold value.

13. A traffic monitoring device as claimed in claim 1, characterized in that said picture analysis unit is provided for generating a vehicle presence signal upon assigning an identification pattern.

14. A traffic monitoring device as claimed in claim 13, characterized in that said picture analysis unit is provided with background grey value compensation means.

15. A method for monitoring traffic present on a traffic road, wherein a sequence of subsequent traffic pictures of the traffic road is recorded, and in the traffic pictures a traffic detection zone is determined, and wherein from the recorded traffic pictures there is verified within the traffic detection zone if an object to be identified as a vehicle is present therein, characterized in that for the traffic detection zone a follower axis is superposed on said traffic picture, which follower axis comprises a predetermined number of points ($X_i$) distributed thereover and which is situated within and extends substantially in parallel with a traffic axis within said traffic road, and in that said verification is executed pointwise on said points situated on said follower axis by verifying if a predetermined grey value threshold is exceeded by the grey value of that point and upon detection of such an object an identification pattern is assigned thereon and from subsequent traffic pictures within said sequence there is verified if patterns corresponding with said identification pattern appear on points of said follower axis.

* * * * *